US008034133B2

(12) United States Patent
Tomiyama

(10) Patent No.: US 8,034,133 B2
(45) Date of Patent: Oct. 11, 2011

(54) GAS GENERATING COMPOSITION

(75) Inventor: Shogo Tomiyama, Himeji (JP)

(73) Assignee: Daicel Chemical Industries, Ltd., Osaka (JP)

( * ) Notice: Subject to any disclaimer, the term of this patent is extended or adjusted under 35 U.S.C. 154(b) by 757 days.

(21) Appl. No.: 11/137,363

(22) Filed: May 26, 2005

(65) Prior Publication Data

US 2005/0274440 A1 Dec. 15, 2005

Related U.S. Application Data

(60) Provisional application No. 60/576,411, filed on Jun. 3, 2004.

(30) Foreign Application Priority Data

May 31, 2004 (JP) ..... 2004-161334

(51) Int. Cl.
*C06D 5/00* (2006.01)

(52) U.S. Cl. ..... 44/628; 102/289; 149/45

(58) Field of Classification Search ..... 149/45; 102/289; 44/53, 381
See application file for complete search history.

(56) References Cited

U.S. PATENT DOCUMENTS

| | | | | |
|---|---|---|---|---|
| 5,386,775 | A * | 2/1995 | Poole et al. | 102/289 |
| 5,827,996 | A * | 10/1998 | Yoshida et al. | 149/45 |
| 6,039,820 | A * | 3/2000 | Hinshaw et al. | 149/45 |
| 6,132,537 | A * | 10/2000 | Zeuner et al. | 149/45 |
| 6,136,111 | A * | 10/2000 | Lemons et al. | 149/19.3 |
| 6,241,281 | B1 * | 6/2001 | Hinshaw et al. | 280/741 |
| 6,554,928 | B2 * | 4/2003 | Astrauskas et al. | 149/19.9 |
| 6,682,616 | B1 * | 1/2004 | Yamato et al. | 149/45 |
| 6,854,395 | B2 | 2/2005 | Katsuda et al. | |
| 6,964,716 | B2 * | 11/2005 | Wu | 149/45 |
| 2003/0030162 | A1 | 2/2003 | Yamamoto et al. | |
| 2003/0094225 | A1 | 5/2003 | Knowlton et al. | |
| 2003/0097953 | A1 * | 5/2003 | Serizawa et al. | 102/531 |
| 2003/0145921 | A1 | 8/2003 | Blomquist et al. | |
| 2009/0101250 | A1 | 4/2009 | Zhou et al. | |

FOREIGN PATENT DOCUMENTS

| | | | |
|---|---|---|---|
| JP | 8-500813 | A | 1/1996 |
| JP | 10-114594 | A | 5/1998 |
| JP | 11-343192 | A | 12/1999 |
| JP | 2001-508751 | A | 7/2001 |
| JP | 2001-342091 | A | 12/2001 |
| JP | 2002-12493 | A | 1/2002 |
| JP | 2002-537218 | A | 11/2002 |
| JP | 2003-112991 | A | 4/2003 |
| JP | 2003-517992 | A | 6/2003 |
| JP | 2006-524176 | A | 10/2006 |
| WO | WO 95/00462 | A1 | 1/1995 |
| WO | WO 98/06486 | A2 | 2/1998 |
| WO | WO 00/50363 | A1 | 8/2000 |
| WO | WO 01/46090 | A2 | 6/2001 |
| WO | WO 03/016244 | A1 | 2/2003 |
| WO | WO 2004-094189 | A2 | 11/2004 |

OTHER PUBLICATIONS

Japanese Office Action issued on Feb. 2, 2010 in corredponding Japanese Patent Application No. 2004-161334.

Nakazato et al., "Study on the gas generating agents of Airbag inflator," School of Engineering, the University of Tokyo, English translation of literature, Abstract of Symposium in Spring 1999, pp. 135-136, Article Serial No. 0049.

* cited by examiner

*Primary Examiner* — Ellen McAvoy
*Assistant Examiner* — Ming Cheung Po
(74) *Attorney, Agent, or Firm* — Birch, Stewart, Kolasch & Birch, LLP

(57) ABSTRACT

There is provided a gas generating composition having a low combustion temperature and a high burning rate.

The gas generating composition comprises fuel and an oxidizing agent, and as necessary a binder and additives, the gas generating composition comprising at least one selected from the group consisting of glycine and a derivative thereof as the fuel. A combination of glycine as the fuel, basic copper nitrate as the oxidizing agent, and carboxymethyl cellulose or a salt thereof as the binder is preferable.

19 Claims, No Drawings

GAS GENERATING COMPOSITION

This Nonprovisional application claims priority under 35 U.S.C. §119(e) on U.S. Provisional Application No. 60/576,411 filed on Jun. 3, 2004, the entire contents of which are hereby incorporated by reference.

TECHNICAL FIELD

The present invention relates to a gas generating composition used in a gas generator for an air bag.

BACKGROUND ART

Gas generating agents used in gas generators for air bags generally comprises fuel, an oxidizing agent, a binder, and various additives; recently, instead of gas generating agents having an azide compound that generates harmful gases as the fuel, gas generating agents having a safer non-azide compound as the fuel have come to be used.

To secure passenger safety by inflating an airbag as planned during an automobile collision, in addition to not generating harmful gases, it is desirable for a gas generating agent used in a gas generator for an air bag to satisfy, for example, the following three requirements.

(a) A low combustion temperature to suppress thermal damage to the air bag.

(b) A low amount of combustion residue to prevent the air bag from being damaged due to combustion residue getting into the air bag.

(c) A high burning rate of the gas generating agent to inflate and develop the air bag within a prescribed time (generally approximately a few tens of milliseconds).

US 2003/094225A1 discloses, as a gas generating composition generating a low amount of residue, one comprising 5-nitrouracil or the like and basic copper nitrate, and US 2003/145921A1 discloses, as a gas generating composition having a combustion temperature at 2100 K° or less, a composition comprising a binder/fuel/an oxidizing agent.

DISCLOSURE OF THE INVENTION

Regarding requirement (a), in the case that the combustion temperature is made high to suitably maintain the combustibility of the gas generating agent which is a explosive, a large amount of a coolant has to be put into the gas generator to suppress thermal damage to the air bag.

Regarding requirement (b), in the case that the amount of combustion residue is high, to suppress the discharge of the combustion residue into the air bag, again a large amount of a coolant has to be put into the gas generator.

Regarding requirement (c), in the case that the burning rate is too low, it may not be possible to inflate the air bag in a prescribed time.

However, if the combustion temperature of the gas generating agent is reduced to satisfy requirement (a), then the burning rate will also drop, and hence it will no longer be possible to satisfy requirement (c). Furthermore, even if requirement (a) is satisfied, it will not be possible to reduce the amount of the coolant unless requirement (b) is also satisfied.

An object of the present invention is to provide a gas generating composition according to which generation of harmful gases upon combustion can be suppressed, and moreover all of requirements (a) to (c) can be satisfied.

As means for attaining this object, the present invention provides a gas generating composition comprising fuel and an oxidizing agent, and as necessary a binder and additives, the gas generating composition comprising at least one selected from the group consisting of glycine and a derivative thereof as the fuel.

With the gas generating composition of the present invention, the generation of harmful gases upon combustion can be suppressed. Furthermore, the gas generating composition of the present invention satisfies all of above requirements (a) to (c), and hence the amount of a coolant put into the gas generating agent can be reduced, and thus the gas generator itself can be made lighter in weight, and moreover damage to an air bag can be prevented, and hence safety upon operation can be improved.

PREFERRED EMBODIMENT OF THE INVENTION

The fuel used in the gas generating composition of the present invention comprises at least one selected from the group consisting of glycine and a derivative thereof; if necessary, fuel components other than glycine and a derivative thereof can be used together therewith.

Examples of the glycine derivative include glycylglycine, anhydrous glycine, glycine anhydride, glycine metal salts, glycine metal coordination complex salts, alanine, iminodiacetic acid, creatine and creatinine.

In the case of using another fuel component together with glycine or a derivative thereof as the fuel, the content of the glycine or derivative thereof in the fuel is preferably not less than 50 mass %, more preferably not less than 70 mass, yet more preferably not less than 80 mass, where only the glycine or derivative thereof are used (note, however, that even in this case, it is permitted for small amounts of other fuel components to be contained either as impurities or to an extent that the effects are not affected at all).

Examples of other fuel components include at least one nitrogen-containing compound selected from the group consisting of tetrazole derivatives such as 5-aminotetrazole, bitetrazole derivatives such as diammonium bitetrazole, triazole derivatives such as 4-aminotriazole, guanidine derivatives such as dicyandiamide, nitroguanidine and guanidine nitrate, triazine derivatives such as trihydrazinotriazine, and oxamide, ammonium oxalate, azodicarbonamide, and hydrazodicarbonamide.

As the oxidizing agent used in the gas generating composition of the present invention, an inorganic oxide is preferable. An example of such inorganic oxides is more preferably at least one selected from the group consisting of basic copper nitrate, sodium nitrate, potassium nitrate, strontium nitrate, sodium perchlorate, potassium perchlorate and strontium perchlorate.

The gas generating composition of the present invention may include a binder as necessary. An example of such a binder is at least one selected from the group consisting of carboxymethyl cellulose (CMC), sodium carboxymethyl cellulose (CMCNa), potassium carboxymethyl cellulose, ammonium carboxymethyl cellulose, cellulose acetate, cellulose acetate butyrate (CAB), methyl cellulose (MC), ethyl cellulose (EC), hydroxyethyl cellulose (HEC), ethyl hydroxyethyl cellulose (EHEC), hydroxypropyl cellulose (HPC), carboxymethyl ethylcellulose (CMEC), microcrystalline cellulose, polyacrylamide, aminated polyacrylamide, polyacrylhydrazide, an acrylamide-metal acrylate copolymer, a polyacrylamide-polyacrylic ester copolymer, polyvinyl alcohol, acrylic rubber, guar gum, starch and silicone.

Of these, considering the adhesive performance, cost, ignitability and so on of the binder, a water-soluble cellulose compound is preferable, with sodium carboxymethyl cellulose (CMCNa) being particularly preferable.

The gas generating composition of the present invention may as necessary include therein any of various additives that are included in publicly known gas generating agents. As such additives, at least one selected from the group consisting of metal oxides such as copper oxide, iron oxide, zinc oxide, cobalt oxide, manganese oxide, molybdenum oxide, nickel oxide, bismuth oxide, silica and alumina, metal carbonates or basic metal carbonates such as cobalt carbonate, calcium carbonate, basic zinc carbonate and basic copper carbonate, composite compounds of a metal oxide or hydroxide such as Japanese acid clay, kaolin, talc, bentonite, diatomaceous earth and hydrotalcite, metal acid salts such as sodium silicate, mica molybdate, cobalt molybdate and ammonium molybdate, molybdenum disulfide, calcium stearate, silicon nitride and silicon carbide can be used.

The contents of the various components in the gas generating composition of the present invention can be selected from the following ranges.

For the fuel, preferably 1 to 50 mass, more preferably 5 to 40 mass, yet more preferably 10 to 30 mass %, of the gas generating composition.

For the oxidizing agent, preferably 20 to 99 mass, more preferably 40 to 95 mass, yet more preferably 60 to 90 mass, of the gas generating composition.

In the case of including a binder, preferably 0.1 to 30 mass, more preferably 0.5 to 20 mass, yet more preferably 3 to 10 mass, of the gas generating composition.

In addition, in the case of including additives as necessary, 0.01 to 20 parts by mass can be included per 100 parts by mass of the fuel, the oxidizing agent and the binder in total, although this will vary according to the type of the additive.

For the gas generating composition of the present invention, in terms of attaining the object of the present invention, a combination of glycine as the fuel, basic copper nitrate as the oxidizing agent, and carboxymethyl cellulose or a salt thereof (particularly CMCNa) as a binder is particularly preferable.

The gas generating composition of the present invention can be made into a molded article having a desired form such as a single-perforated cylinder, a porous cylinder, pellets or the like. Such a molded article can be manufactured using a method in which water or an organic solvent is added to the gas generating agent and mixing is carried out, and then extrusion molding is carried out (for a molded article having the form of a single-perforated cylinder or a porous cylinder), or a method in which compression-molding is carried out using a pelletizer or the like (for a molded article having the form of pellets); the method described in JP-A No. 2001-342091 can also be used.

The gas generating composition of the present invention can be used, for example, in any of various vehicles in an inflator for an airbag for a driver side (gas generator), an inflator for an air bag for a front passenger side, a side air bag inflator, an inflatable curtain inflator, a knee bolster inflator, an inflatable seat belt inflator, a tubular system inflator, or a pretensioner inflator.

In addition to use being possible as a gas generating composition for an inflator (gas generator), the gas generating composition of the present invention can also be used as an igniting agent called an enhancer (or a booster) for transferring energy from a detonator or a squib to a gas generating composition.

EXAMPLES

Measurement methods for the examples and comparative examples will now be shown. Note that 'parts' in the following means 'parts by mass'.

(1) Method of Preparing Cylindrical Strand

A powder of the composition of each example and comparative example (a mixed powder for molding, as in Table 1) was filled into the mortar side of a prescribed die, compression at a pressure of 14.7 MPa was held for five seconds using a hydraulic pump from the end face on the pestle side, and then the molded article was taken out, whereby molding into a cylindrical strand having an outside diameter of 9.55 mm and a length of 12.70 mm was carried out. An epoxy resin-based chemical reaction-type adhesive ('BONDQUICK 30' manufactured by Konishi Co., Ltd.) was applied onto the side face of the cylindrical strand, and then thermosetting was carried out for 16 hours at 110° C., thus obtaining a sample for which ignition would not occur from the side face, but rather ignition and thus combustion would occur only from an end face (single-face moving combustion occurs).

(2) Method of Measuring Burning Rate

Each sample cylindrical strand was installed in an SUS sealed chamber having an internal volume of 1 L, and while completely purging the inside of the chamber with nitrogen, pressurization up to and stabilization at 7 MPa was carried out. After that, a prescribed current was passed into a nichrome wire in contact with an end face of the strand, thus carrying out ignition and hence combustion through the fusing energy of the nichrome wire. The behavior of the pressure over time in the chamber was determined using a recorder chart, the time elapsed from the start of combustion until the pressure peaked was determined from the scale on the chart, and the value calculated by dividing the length of the strand before combustion by the elapsed time was taken as the burning rate.

(3) Method of Measuring Gas Concentrations

Each sample cylindrical strand (mass 2.00 g) was installed in an SUS sealed chamber having an internal volume of 1 L, and while completely purging the inside of the chamber with nitrogen, pressurization up to and stabilization at 7 MPa was carried out. After that, a prescribed current was passed into a nichrome wire in contact with an end face of the strand, thus carrying out ignition and hence combustion through the fusing energy of the nichrome wire. 60 seconds was waited so that the gas in the chamber would become uniform, and then an open stopper portion of a prescribed stopper-possessing Tedlar bag was connected to a gas discharge portion of the chamber, a sample was taken by transferring the combustion gas in the chamber into the Tedlar bag, and the concentrations of $NO_2$, NO, $NH_3$ and CO were measured by Gastec gas detecting tubes (no. 10 for detecting $NO_2$ and NO, no. 3 L for detecting $NH_3$, and no. 1 L for detecting CO,) using a GV-100S detector Made by GASTEC CO.

(4) Mass of Recovered Residue

After the above '(3) Method of measuring gas concentrations' test had been completed, the state inside the chamber was visually observed, and moreover the residue inside the chamber was recovered, and the mass thereof was measured after drying for 16 hours at 110° C.

Example 1

14.8 parts of glycine and 85.2 parts of basic copper nitrate were passed twice through an SUS sieve having a 300 μm mesh to make the grains uniform, and were mixed together to obtain a composition of the present invention. The measurement results are shown in Table 1.

Example 2

21.69 parts of glycine, 73.31 parts of basic copper nitrate, and 5 parts of CMCNa were passed twice through an SUS sieve having a 300 μm mesh to make the grains uniform, and a mixed powder was thus obtained. 20 parts of ion exchange water was added to 100 parts of this mixed powder, and mixing was carried out thoroughly, and then drying was carried out for 1 hour at 110° C., thus obtaining a composition of the present invention. The measurement results are shown in Table 1.

Comparative Examples 1 and 2

Using the components shown in Table 1, compositions were obtained as for Examples 1 and 2 respectively. The measurement results are shown in Table 1.

Examples 3 to 7

Using the components shown in Table 1, compositions of the present invention were obtained as for Example 1 in the case of not using CMCNa or as for Example 2 in the case of using CMCNa. The measurement results are shown in Table 1.

TABLE 1

| | Example | | Comparative example | | Example | | | | |
|---|---|---|---|---|---|---|---|---|---|
| | 1 | 2 | 1 | 2 | 3 | 4 | 5 | 6 | 7 |
| Glycine | 14.8 | 21.69 | | | | | | | 25.06 |
| Glycylglycine | | | | | 29.77 | 26.08 | | 26.08 | |
| Anhydrous glycine | | | | | | | 29.77 | | |
| Guanidine nitrate | | | 53.36 | 46.21 | | | | | |
| Basic copper nitrate | 85.2 | 73.31 | 46.64 | 48.79 | | 68.92 | | 68.92 | 36.66 |
| Potassium perchlorate | | | | | 70.23 | | 70.23 | | 33.28 |
| CMCNa | | 5.00 | | 5.00 | | 5.00 | | 5.00 | 5.00 |
| Burning rate(mm/sec) | 13.12 | 13.92 | 9.91 | 9.64 | 13.28 | 13.94 | 13.28 | 13.94 | 23.76 |
| Gas Concentration(ppm) | | | | | | | | | |
| $NO_2$ | 0 | 0 | 0 | 0 | 2.5 | 0 | 2.5 | 0 | 0 |
| NO | 12 | 14 | 42 | 19 | 19 | 24 | 19 | 24 | 2 |
| $NH_3$ | 0 | 20 | 1 | 29 | 0 | 2 | 0 | 2 | 2 |
| CO | 100 | 270 | 110 | 410 | 100 | 280 | 100 | 280 | 290 |
| Mass of residue(g) | 0.89 | 0.79 | — | — | — | 0.72 | — | 0.74 | 0.63 |

As shown above, for the compositions of the examples, the amount of harmful gases generated upon combustion was suppressed. Moreover, upon visually observing the state inside the chamber after the '(3) Method of measuring gas concentrations' test had been Completed, the state was as follows.

For Example 1, only one almost cylindrical metallic copper mass was observed as residue with very good slag formation without substantial residue scattered around, and for Example 2, again only one almost cylindrical metallic copper mass was observed. Furthermore, for Examples 4 and 6, only one cylindrical metallic copper mass was observed as residue with very good slag formation without substantial residue scattered around.

For Comparative Example 1, residue scattered around as countless fine metallic copper particles was observed. The scattering around of such fine metallic copper particles may damage an air bag when the air bag is inflated and developed. For Comparative Example 2, residue scattered around as several metallic copper particles of size approximately 1 mm was observed. The scattering around of such metallic copper particles may damage an air bag when the air bag is inflated and developed.

In this way, the compositions of the examples have high combustion gas safety, and good slag formation ability (i.e., without substantial residue scattered around) and also a low combustion temperature, and yet the burning rate is sufficiently high.

The invention claimed is:

1. A gas generating composition comprising:

fuel comprising not less than 70 mass % in the fuel of at least one selected from the group consisting of glycylglycine, glycine metal salts, alanine, iminodiacetic acid and creatine;

a basic cooper nitrate in an amount of 60 to 90 mass % of the gas generating composition; and an effective binding amount of a binder comprising a single water-soluble cellulose compound selected from the group consisting of carboxymethyl cellulose, methyl cellulose, ethyl cellulose, ethyl hydroxyethyl cellulose, hydroxypropyl cellulose, and carboxymethyl ethyl cellulose or a salt thereof.

2. The gas generating composition according to claim 1, wherein the binder is carboxymethyl cellulose or a salt thereof.

3. The gas generating composition according to claim 1, wherein the total amount of glycylglycine, glycine metal salts, alanine, iminodiacetic acid and creatine is not less than 80 mass % in the fuel.

4. The gas generating composition according to claim 1, wherein the water-soluble cellulose compound is present in an amount of 0.1 to 30 mass % in the gas generating composition.

5. The gas generating composition according to claim 1, wherein the water-soluble cellulose compound is present in an amount of 0.5 to 20 mass % in the gas generating composition.

6. The gas generating composition according to claim 1, wherein the water-soluble cellulose compound is present in an amount of 3 to 10 mass % in the gas generating composition.

7. The gas generating composition of claim 1, further comprising:

at least one additive selected from the group consisting of metal oxides, metal carbonates, basis metal carbonates, composite compounds of a metal oxide or hydroxide, metal and salts, molybdenum disulfide, calcium stearate, silicon nitride and silicon carbide.

8. The gas generating composition according to claim 1, wherein said fuel comprises glycylglycine.

9. The gas generating composition according to claim 1, wherein the binder consists of sodium carboxymethyl cellulose.

10. A gas generating composition comprising:

1 to 50 mass %, based on the entire mass of the composition, of a fuel comprising at least one selected from the group consisting of glycylglycine, glycine metal salts, alanine, iminodiacetic acid and creatine, wherein the amount of the glycine or the derivative thereof is not less than 70 mass % of the fuel;

a basic copper nitrate in an amount of 60 to 90 mass % of the gas generating composition; and 0.1 to 30 mass %, based on the entire mass of the composition, of a binder comprising a single water-soluble cellulose compound selected from the group consisting of carboxymethyl cellulose, methyl cellulose, ethyl cellulose, ethyl hydroxyethyl cellulose, hydroxypropyl cellulose and carboxymethyl ethyl cellulose or a salt thereof.

11. The gas generating composition according to claim 10, wherein the total amount of the glycylglycine, glycine metal salts, alanine, iminodiacetic acid and creatine is not less than 70 mass % in the fuel.

12. The gas generating composition according to claim 10, wherein the total amount of the glycylglycine, glycine metal salts, alanine, iminodiacetic acid and creatine is not less than 80 mass % in the fuel.

13. The gas generating composition according to claim 10, wherein the binder is carboxymethyl cellulose or a salt thereof.

14. The gas generating composition according to claim 10, wherein the water-soluble cellulose compound is present in an amount of 0.5 to 20 mass % in the gas generating composition.

15. The gas generating composition according to claim 10, wherein the water-soluble cellulose compound is present in an amount of 3 to 10 mass % in the gas generating composition.

16. The gas generating composition according to claim 10, wherein said fuel comprises glycylglycine.

17. The gas generating composition according to claim 10, wherein the binder consists of sodium carboxymethyl cellulose.

18. A gas generating composition consisting essentially of:

fuel comprising not less than 70 mass % in the fuel of at least one selected from the group consisting of glycylglycine, glycine metal salts, alanine, iminodiacetic acid, and creatine;

basic copper nitrate in an amount of 60 to 90 mass % of the gas generating composition; and an effective binding amount of a binder comprising a single water-soluble cellulose compound selected from the group consisting of carboxymethyl cellulose, methyl cellulose, ethyl cellulose, ethyl hydroxyethyl cellulose, hydroxypropyl cellulose and carboxymethyl ethyl cellulose or a salt thereof.

19. The gas generating composition according to claim 18, wherein the binder consists of sodium carboxymethyl cellulose.

* * * * *